US005816959A

United States Patent [19]

Lin et al.

[11] Patent Number: 5,816,959

[45] Date of Patent: Oct. 6, 1998

[54] METHOD FOR MAKING GAME RACKET

[76] Inventors: Se Lin; Johnny Lin, both of No. 747, Chong San Road, Ser Nan Tsuen, Shern Gan Hsiang, Taichung Hsien, Taiwan

[21] Appl. No.: 938,761

[22] Filed: Sep. 26, 1997

Related U.S. Application Data

[63] Continuation-in-part of Ser. No. 823,074, Mar. 24, 1997, Pat. No. 5,735,759.

[51] Int. Cl.[6] ..... A63B 49/00

[52] U.S. Cl. ..... 473/540; 473/543; 473/544

[58] Field of Search ..... 473/528, 529, 473/532, 535, 536, 545, 544, 546, 540

[56] References Cited

U.S. PATENT DOCUMENTS

| | | | |
|---|---|---|---|
| 2,969,984 | 1/1961 | Presnick | 473/543 |
| 3,545,756 | 12/1970 | Nash | 473/540 |
| 3,814,423 | 6/1974 | Shockley et al. | 473/544 |
| 4,029,317 | 6/1977 | Malmstrom | 473/540 |
| 4,741,531 | 5/1988 | Szedressy | 473/540 |
| 5,188,359 | 2/1993 | Wu | 473/528 |
| 5,217,222 | 6/1993 | Rudell et al. | 473/528 |
| 5,294,114 | 3/1994 | Stillinger | 473/528 |
| 5,413,335 | 5/1995 | Braun | 473/532 X |
| 5,735,759 | 4/1998 | Lin et al. | 473/540 |

*Primary Examiner*—William E. Stoll

[57] ABSTRACT

A method for making a game racket includes two molds having a mold cavity for receiving an annular rib and a network engaged between the molds and engaged with the annular rib. A material is injected into the mold cavity of the molds for forming the annular frame of the game racket and for forming the annular rib in the annular frame and for allowing the network to be secured to the annular frame without threading operation. The annular rib has one or more holes for engaging with the material and for allowing the annular rib to be solidly secured in the annular frame.

9 Claims, 5 Drawing Sheets

METHOD FOR MAKING GAME RACKET

The present invention is a continuation-in-part of U.S. patent application Ser. No. 08/823,074, filed on Mar. 24, 1997 now U.S. Pat. No. 5,735,759.

BACKGROUND OF THE INVENTION

1. Field of the Invention

The present invention relates to a method, and more particularly to a method for making a game racket.

2. Description of the Prior Art

Typical game rackets for entertaining purposes comprise a tube secured between a racket frame and a hand grip, and one or more threads threaded through the racket frame so as to form a striking surface. However, typical game rackets required to thread the threads manually such that the manufacturing speed is decreased and the manufacturing cost is greatly increased.

A game racket which is not required to be threaded is disclosed in U.S. Pat. No. 2,969,984 to Presnick and comprises a grid to be engaged in a frame member. The grid includes a peripheral bead provided around a network and made integral with the network. However, the network is formed integral with the peripheral bead and should be made by the same material as that for the peripheral bead, such as plastic material, such that the network may not be made by the typical network and may not be formed with excellent bouncing effect as that of the typical network. In addition, no reinforcing material may be provided in the peripheral bead.

The present invention has arisen to mitigate and/or obviate the afore-described disadvantages of the conventional game rackets.

SUMMARY OF THE INVENTION

The primary objective of the present invention is to provide a method for making a game racket having a striking surface that is not required to be threaded manually and for providing a reinforcing member in the game racket.

In accordance with one aspect of the invention, there is provided a method for making a game racket comprises an annular frame, and a network engaged in the annular frame, the method comprises providing an upper mold and a lower mold each having a mold cavity, the mold cavities including a shape corresponding to that of the annular frame of the game racket, preparing and engaging an annular rib in the mold cavity of the lower mold, engaging the network on the lower mold for engaging the network with the annular rib, engaging the upper mold and the lower mold together, and injecting a material into the mold cavities for forming the annular frame of the game racket and for forming the annular rib in the annular frame and for allowing the network to be secured to the annular frame without threading operation.

The annular rib includes at least one hole for engaging with the material and for allowing the annular rib to be solidly secured in the annular frame. The network includes a peripheral portion engaged with the annular rib.

A tube includes a first end engaged in the mold cavities before injecting the material into the mold cavities for allowing the first end of the tube to be secured to the annular frame. The tube includes a first end secured to the annular frame and includes a second end having a hand grip.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
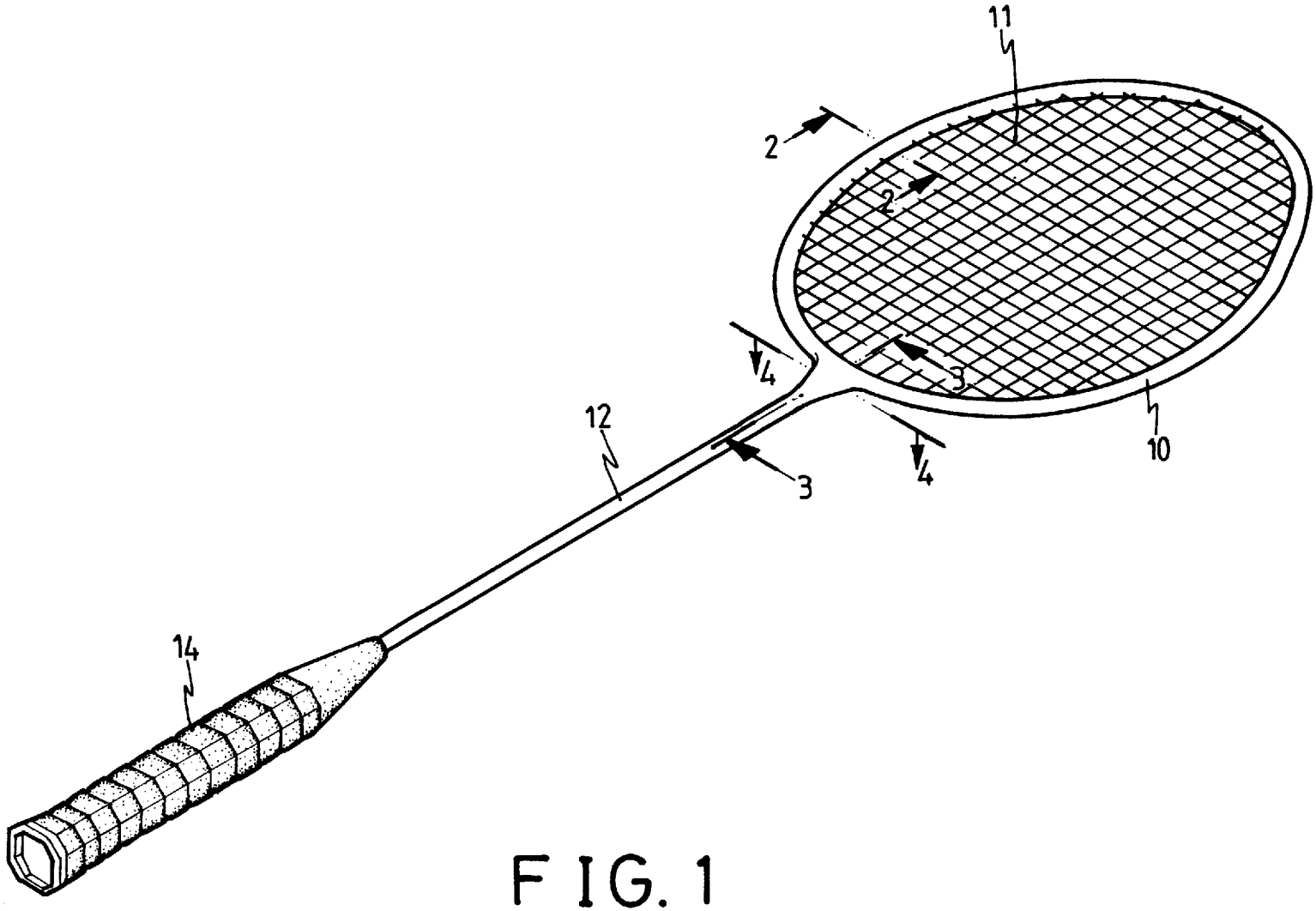
FIG. 1 is a perspective view of a game racket to be made by a method in accordance with the present invention.

Referring to the drawings, and initially to FIGS. 1–4, a game racket made by a method in accordance with the present invention comprises a tube 12 secured between a frame 10 and a hand grip 14. The frame 10 is formed with plastic material and includes a striking surface 11 formed by a network of strings. An annular rib 15 for reinforcing purposes is engaged in the frame 10. The network 11 has a peripheral portion engaged with the upper portion of the annular rib 15. The tube 12 includes a flat end 17 contacted and engaged with the annular rib 15 before the throat portion 16 is molded or formed. The engagement of the network 11 with the annular rib 15 may hold the network 11 and may prevent the network 11 from being easily become loose.

Figure 5:
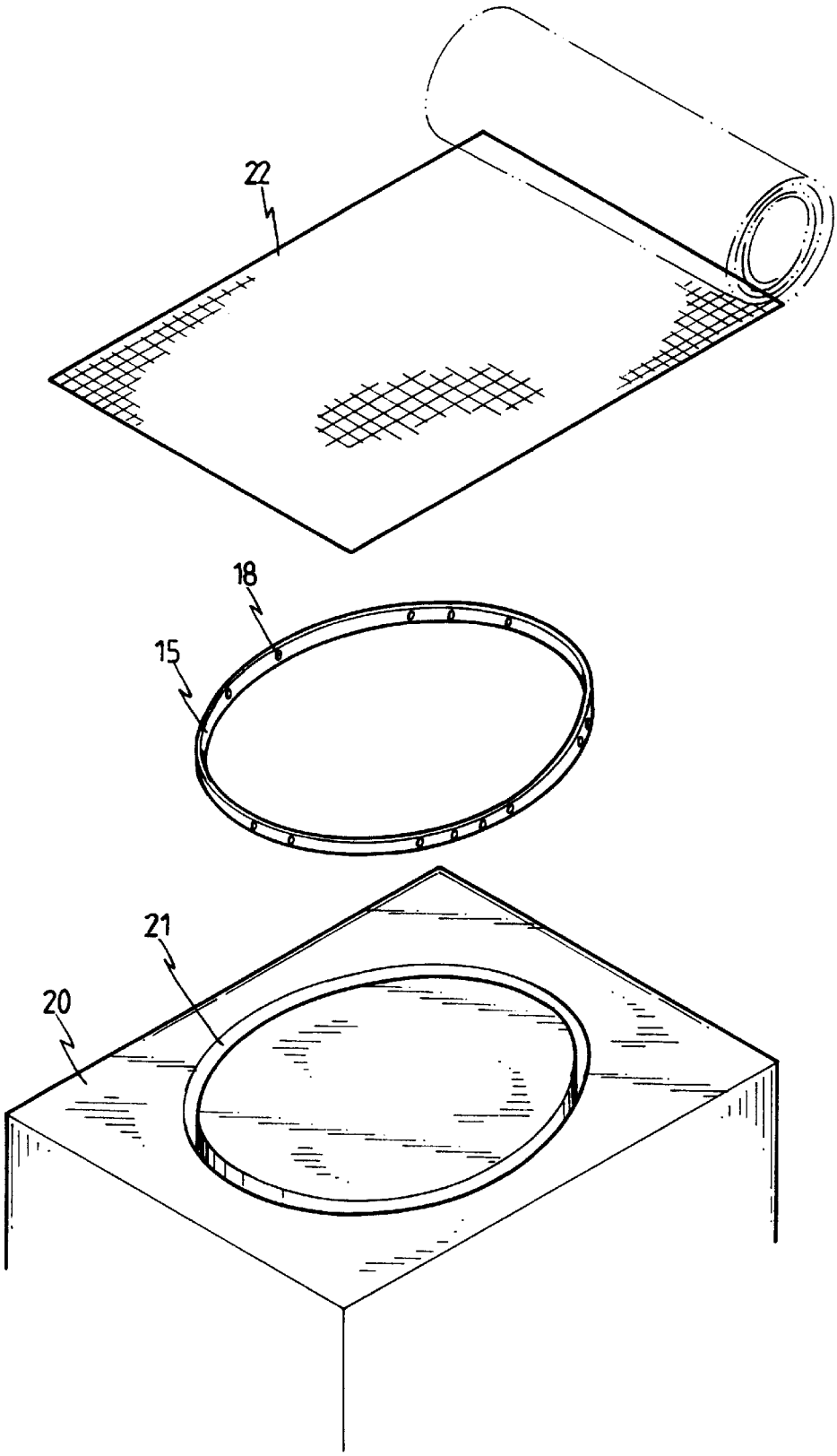
FIG. 5 is a partial exploded view showing the arrangement for making the game racket.
Figure 6:
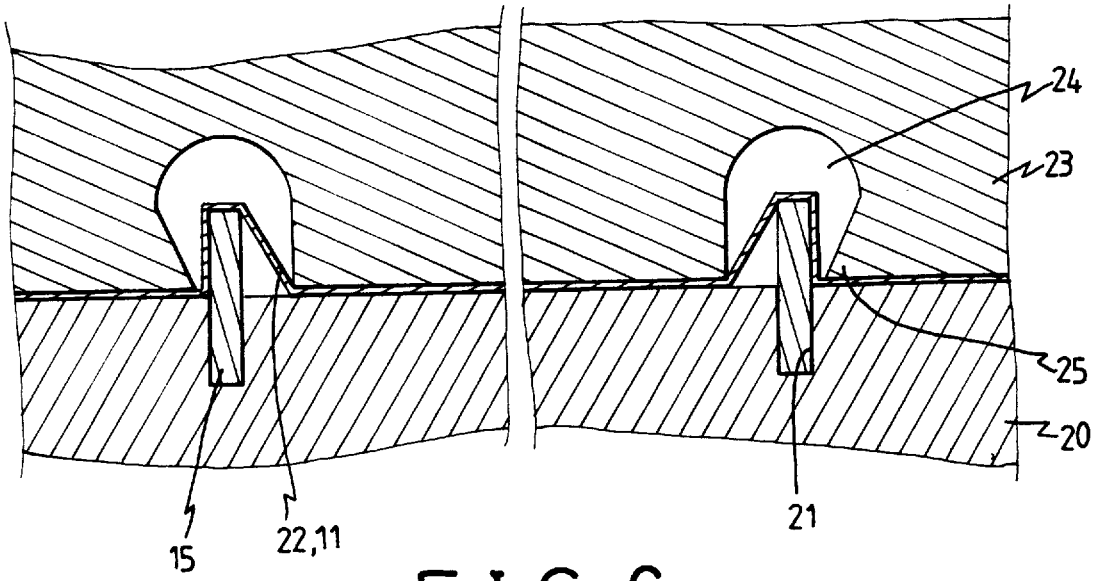
FIGS. 6, 7, 8 are cross sectional views illustrating the manufacturing of the game racket.
Figure 7:
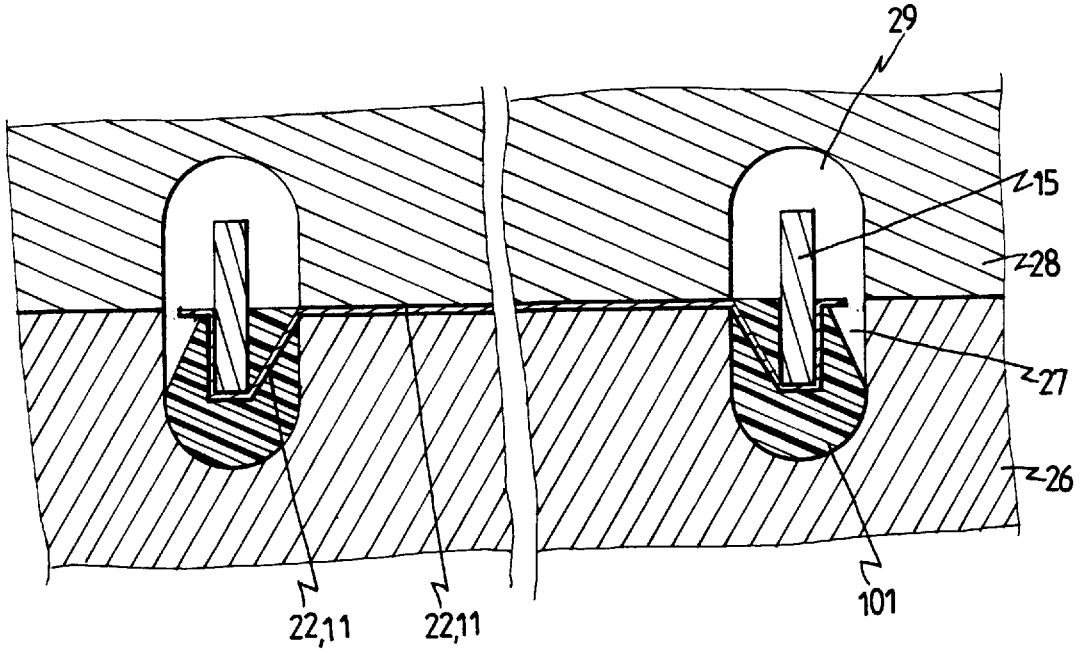

Referring next to FIGS. 5–7, a lower mold 20 includes an annular groove 21 for engaging with the lower portion of the annular rib 15. It is preferably that one or more holes 18 are formed in the annular rib 15 for engaging with the plastic material which forms the frame 10 and for allowing the annular rib 15 to be solidly engaged in the frame 10. A screen 22 is disposed above the annular rib 15 and is depressed toward the lower mold 20 by an upper mold 23 which includes a mold cavity 24 for receiving the upper portion of the annular rib 15 and the peripheral portion of the screen 22 which forms the network or the striking surface 11 of the game racket. The plastic material is then injected into the mold cavity 24 of the upper mold 23 (FIG. 6) for forming a prototype 101 (FIG. 7) of the game racket. The plastic material may engage in the screen holes of the screen 22 and may engage in the holes 18 of the annular rib 15 such that the screen 22 and the annular rib 15 may be solidly secured together by the plastic material.

Figure 2:
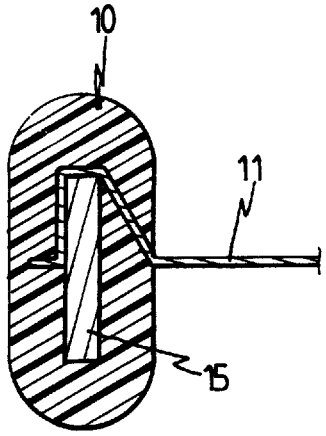
FIGS. 2, 3, 4 are cross sectional views taken along lines 2—2, 3—3, 4—4 of FIG. 1.
Figure 3:
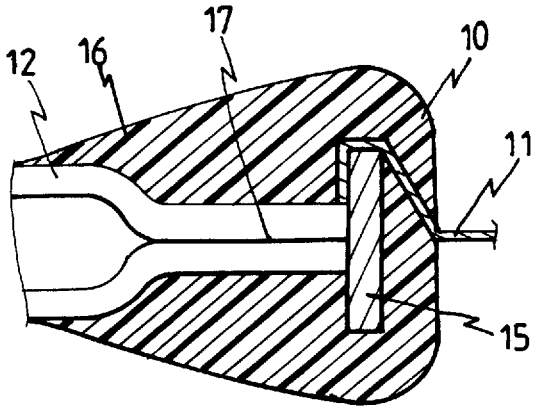
Figure 4:
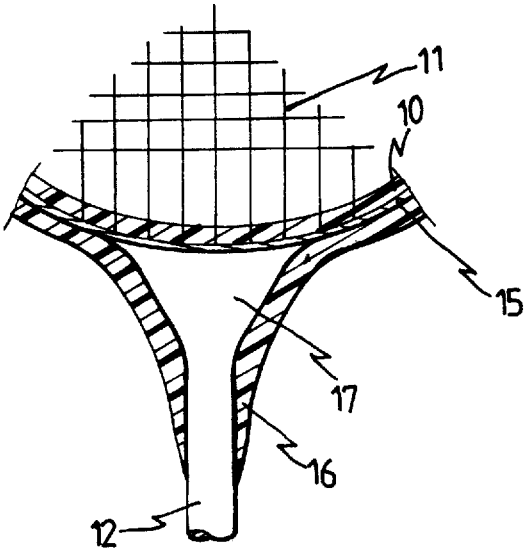

As shown in FIG. 7, the prototype 101 of the game racket is then disposed up side down in a mold cavity 27 of another lower mold 26. Another upper mold 28 is engaged on the lower mold 26 and has a mold cavity 29 communicating with the mold cavity 27 of the lower mold 26. The mold cavities 27, 29 have a shape corresponding to that of the frame 10 of the game racket. The plastic material is then injected into the mold cavity 29 for forming the frame 10 as shown in FIGS. 1 and 2, and for further solidly receiving the annular rib 15 in the frame 10. The screen or the network 11 may thus be solidly formed in the frame 10 without threading operations. The annular rib 15 is secured in the prototype 101 such that the prototype 101 may also be engaged in the mold cavities 27, 29 without being disposed up side down.

As best shown in FIG. 6, it is preferable that the upper mold 23 includes a projection 25 extended inward of the mold cavity 24 for pressing the outer peripheral portion of the screen 22 to engage with the outer peripheral surface of the annular rib 15 and for allowing the screen 22 to be solidly secured in the frame 10 by the annular rib 15. The prototype 101 of the frame 10 may be disengaged from the mold cavity 24 before the plastic material is hardened or cured.

Figure 8:
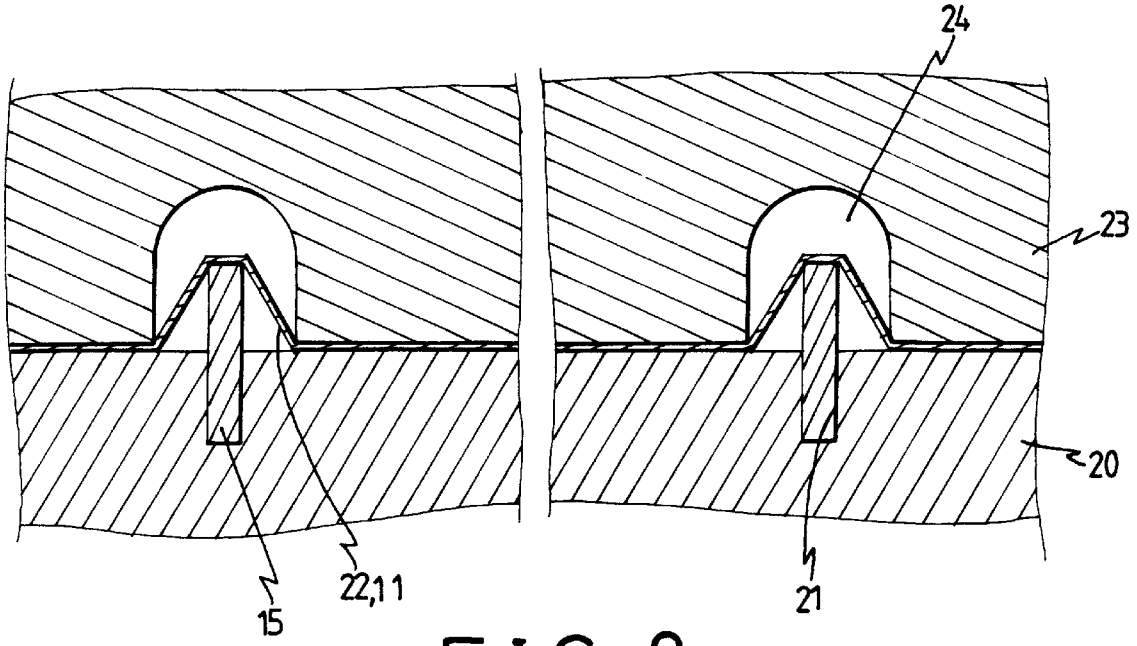

Referring next to FIG. 8, without the projection 25, the screen 22 may also be folded or bent relative to the annular rib 15 with a suitable inclination such that the screen 22 may also be solidly secured in the frame 10 by the annular rib 15.

Figure 9:
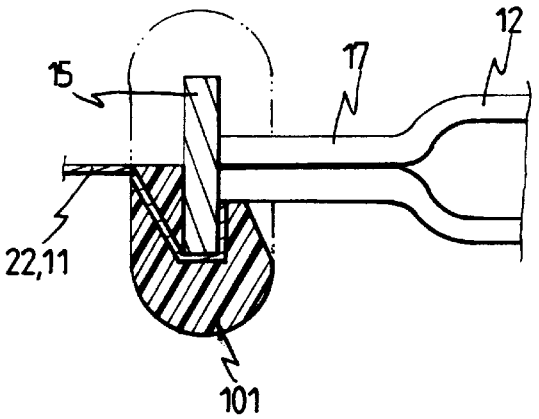
FIG. 9 is a schematic view illustrating the prototype of the game racket.

Referring next to FIG. 9, the flat end 17 of the tube 12 may be engaged with the annular rib 15 when only one half of the frame is formed and may be secured in the frame 10 when the throat 16 is molded. A small portion of the prototype 101 is required to be cut off for engaging with the flat end 17 of the tube 12. The flat end 17 may include one or more projection for engaging into the holes 18 of the annular rib 15 and for further solidly securing the tube 12 to the frame 10.

It is to be noted that the frame may also be formed by a single molding process and by engaging the annular rib in the mold cavity of a mold device, in which the mold cavity of the mold device has a shape corresponding to that of the frame 10 for allowing the annular rib 15 to be directly formed in the frame 10 by the single molding process. The annular rib 15 may include three or more projections extended downward for engaging with the mold device and for supporting the annular rib 15 in the middle portion of the mold cavities and for allowing the annular rib 15 to be formed in the molded frame 10.

Accordingly, the method in accordance with the present invention may solidly secure a network in the frame without threading operations and may engage a reinforcing member in the racket frame during the molding process.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A method for making a game racket, the game racket comprising an annular frame, and a network engaged in the annular frame, said method comprising:

providing an upper mold and a lower mold each having a mold cavity, said mold cavities including a shape corresponding to that of the annular frame of the game racket, preparing and engaging an annular rib in said mold cavity of said lower mold, engaging the network on said lower mold for engaging the network with said annular rib, engaging said upper mold and said lower mold together, and injecting a material into said mold cavities for forming the annular frame of the game racket and for forming the annular rib in the annular frame and for allowing the network to be secured to the annular frame without threading operation.

2. The method according to claim 1, wherein said annular rib includes at least one hole for engaging with said material and for allowing said annular rib to be solidly secured in said annular frame.

3. The method according to claim 1, wherein the network includes a peripheral portion engaged with said annular rib.

4. The method according to claim 1 further comprising: providing a tube and engaging a first end of said tube in said mold cavities before injecting said material into said mold cavities for allowing said first end of said tube to be secured to said annular frame.

5. The method according to claim 4, wherein the tube includes a first end secured to said annular frame and includes a second end having a hand grip.

6. A method for making a game racket, the game racket comprising an annular frame, a tube secured to said annular frame, and a network engaged in the annular frame, said method comprising:

providing a first lower mold having an annular groove, providing an annular rib and engaging a lower portion of said annular rib in said annular groove of said first lower mold, providing a first upper mold, said first upper mold including a mold cavity for receiving an upper portion of said annular rib, engaging the network on said lower mold for engaging the network with said upper portion of said annular rib, engaging said upper mold and said lower mold together, injecting a material into said mold cavity of said first upper mold for forming a prototype, providing a second lower mold and a second upper mold each having a mold cavity, said mold cavities of said second lower mold and said second upper mold including a shape corresponding to that of the annular frame of the game racket, engaging said prototype in said mold cavities of said second lower mold and said second upper mold, and injecting a material into said mold cavities of said second lower mold and said second upper mold for forming the annular frame of the game racket and for forming the annular rib in the annular frame and for allowing the network to be secured to the annular frame without threading operation.

7. The method according to claim 6, wherein the network includes a peripheral portion engaged with said annular rib.

8. The method according to claim 7, wherein said first upper mold includes a projection extended inward of said mold cavity of said first upper mold for pressing said peripheral portion of the network to engage with the annular rib.

9. The method according to claim 6, wherein said annular rib includes at least one hole for engaging with said material and for allowing said annular rib to be solidly secured in said annular frame.

* * * * *